US005233842A

United States Patent [19]

Manning et al.

[11] Patent Number: 5,233,842

[45] Date of Patent: Aug. 10, 1993

[54] ACCUMULATOR FOR REFRIGERATION SYSTEM

[75] Inventors: Thomas O. Manning, Bloomington; Michael T. Nelson, Eagan, both of Minn.

[73] Assignee: Thermo King Corporation, Minneapolis, Minn.

[21] Appl. No.: 907,087

[22] Filed: Jul. 1, 1992

[51] Int. Cl.[5] ..... F25B 49/00

[52] U.S. Cl. ..... 62/132; 62/472; 62/503

[58] Field of Search ..... 62/132, 503, 471, 472

[56] References Cited

U.S. PATENT DOCUMENTS

| | | | |
|---|---|---|---|
| 4,537,045 | 8/1985 | Mayer | 62/503 |
| 4,583,377 | 4/1986 | Viegas | 62/503 |
| 4,942,743 | 7/1990 | Gregory | 62/503 |

FOREIGN PATENT DOCUMENTS

| | | | |
|---|---|---|---|
| 2-154957 | 6/1990 | Japan | 62/503 |

OTHER PUBLICATIONS

P. 18 of Thermo King Corporation's Refrigeration Systems Maintenance Manual–Copyright 1970.

*Primary Examiner*—William E. Wayner
*Attorney, Agent, or Firm*—M. J. Moran

[57] ABSTRACT

A heated accumulator for a refrigeration system includes a cylindrical tank closed by upper and lower tank caps. The tank is divided into upper and lower chambers by a plate disposed near the upper tank cap, with the lower chamber defining a sump. The plate includes a central opening surrounded by smaller openings. An outlet U-tube has a first end disposed within the central opening of the plate, a second end which extends through the upper tank cap, and a central portion which extends into the sump. A refrigerant inlet tube includes swirl ports which direct refrigerant into a vortex against the inner surface of an upper portion of the tank. Heat is applied to this same upper tank portion, introducing heat directly into the swirling liquid refrigerant. Refrigerant vaporized by the heat rises into the upper tank chamber where it is drawn by compressor suction into the outlet U-tube.

12 Claims, 2 Drawing Sheets

ACCUMULATOR FOR REFRIGERATION SYSTEM

TECHNICAL FIELD

The invention relates to an accumulator for a vapor compression refrigeration system.

BACKGROUND ART

An accumulator tank, hereinafter called an accumulator, is often disposed between a refrigerant evaporator and the suction port of a refrigerant compressor in a vapor compression refrigeration system. The function of the accumulator is to collect liquid refrigerant which may exit the evaporator and prevent it from entering the compressor until it can be evaporated.

It is common to add heat to the accumulator to enhance hot gas heating and/or defrost cycles by evaporating greater quantities of liquid refrigerant. This accelerates the amount of refrigerant available in the active refrigerant circuit for use in the hot gas heating or defrosting cycle. Users of heated accumulators, however, often experience certain problems. A first problem encountered is in properly controlling the heat input to the liquid refrigerant to prevent boil-over, which results in defeating the primary purpose of the accumulator. Boil-over allows excessive liquid refrigerant to be carried over into the suction line and into the compressor, an action called "slugging". Slugging is to be avoided, as it may be damaging to the compressor head, and other moving compressor parts, shortening the useful operating life of the compressor. A second problem encountered is in the inability to heat the liquid refrigerant entering the accumulator rapidly enough to achieve a desired rapid build up of refrigerant in the active refrigerant circuit during heating and defrost operations. Failure to heat the liquid refrigerant rapidly results in slow build-up of heat for heating a conditioned load to hold a selected set point temperature during a heating cycle, and slow build-up of heat for heating an evaporator coil during a defrosting cycle. Thus, the heating and defrosting cycles are longer than desired.

It would be desirable, and it is an object of the present invention, to provide a heated accumulator constructed to heat liquid refrigerant entering the accumulator very rapidly, without resulting in the hereinbefore mentioned detrimental boil-over of liquid refrigerant into the suction line and refrigerant compressor.

SUMMARY OF THE INVENTION

Briefly, the invention is a new and improved refrigerant accumulator for interconnecting a refrigerant evaporator with a suction port of a refrigerant compressor. The accumulator comprises an upright, cylindrical metallic tank, having a side wall which defines inner and outer surfaces, and upper and lower ends, which are closed by suitable end cap means. A plate member having a first opening and at least one second opening is disposed to divide the tank into a relatively small upper chamber located near the closed upper end, and a lower chamber which defines a sump. An outlet U-tube is disposed in the lower chamber, with the outlet U-tube having first and second ends. The first end is disposed in vapor flow communication with the upper chamber via the first opening in the plate member, and the second end, which is located outside the tank, is adapted for connection to a suction port of a refrigerant compressor. A refrigerant inlet tube is provided having first and second ends. The first end, which is outside the tank, is adapted for connection to a refrigerant evaporator, and the second end extends into the tank. The refrigerant inlet tube defines at least one swirl port adjacent to the second end, with the at least one swirl port being located below and adjacent to the plate member, and oriented to direct liquid refrigerant which enters the inlet tube into a vortex against the inner surface of a predetermined upper portion of the tank side wall.

Heating means is disposed to selectively heat the predetermined upper portion of the tank sidewall, whereby liquid refrigerant in the vortex is quickly and efficiently vaporized by the heating means in the upper portion of the tank. The vaporized refrigerant escapes the vortex and rises into the upper chamber through the at least one second opening in the plate member, for removal via the outlet U-tube.

More specifically, in a preferred embodiment of the invention, the heated accumulator includes an upright cylindrical metallic tank having upper and lower ends closed by upper and lower tank caps. The cylindrical tank is divided into upper and lower tank chambers by a strainer plate which is disposed close to the upper tank cap. The lower tank chamber defines a sump for holding liquid refrigerant and compressor oil. The strainer plate includes a central opening closely surrounded by a plurality of smaller openings.

An outlet U-tube having first and second leg members, a connecting bight portion, and first and second open ends, has the first open end disposed within the central opening of the strainer plate. The second leg portion extends through the strainer plate and upper tank cap, such that the second open end is outside the tank. The central bight portion, which includes a screen protected oil return metering orifice, extends downwardly into the sump.

An inlet tube having first and second ends, extends downwardly through the upper tank cap and strainer plate, adjacent to the side wall of the tank. The first end of the inlet tube, which is outside the tank, is adapted to receive refrigerant from a refrigerant evaporator, and the second end, which is inside the tank, includes a plurality of refrigerant swirl ports. The swirl ports are oriented to direct entering refrigerant into a vortex or swirling movement against and around the inner surface of the upper portion of the tank, between the strainer plate and approximately the mid-point of the up-right cylindrical tank. Heat is applied to the outside surface of the metallic tank at the same location where swirling liquid refrigerant is in intimate contact with the tank, ie., between approximately the mid-point of the tank height and the still higher location of the strainer plate.

Heat may be applied to the desired upper tank portion by fixing a metallic heat transfer tube to the outer surface of the tank wall in the desired location, such as by soldering or welding the metallic tube to the outer tank wall. Hot liquid coolant from an associated internal combustion engine is then selectively circulated through the heat transfer tube during heating and defrost cycles. Instead of using a heat transfer tube for conducting hot liquid, other forms of heat transfer means may be used. For example, an electrically heated pad may be wrapped around the upper portion of the tank.

Thus, heat is rapidly transferred from an external heating source directly into the swirling liquid refrigerant in an upper portion of the tank, well removed from any liquid refrigerant in the sump, resulting in vaporized refrigerant escaping from the whirling vortex towards the center of the vortex and the vertical centerline of the tank. The escaping vapor rises into the upper chamber through the small openings surrounding the first leg of the outlet U-tube which extends into the central opening, and compressor suction draws this vaporized refrigerant downwardly through the first open end of the U-tube, and out the second end to the compressor, concomitantly drawing compressor oil from the sump into the flowing stream of vapor via the screen protected oil metering orifice in the bight of the U-tube.

Introducing heat into the upper portion of the tank where the liquid refrigerant is forced to swirl in intimate contact with the inner tank wall heats the liquid refrigerant rapidly, for rapid evaporation, rapid return to the compressor, and rapid return to the active heating or defrosting cycle. The elevated location of heat application keeps heat away from the lower sump portion of the tank where liquid refrigerant collects. Thus, with little heat being introduced into the liquid in the bottom portion of the tank, the chances of liquid boil-over and damaging slugging are greatly reduced.

Movement of liquid refrigerant along the bottom surface of the strainer plate towards the small openings therein, and upward movement of liquid refrigerant and compressor oil on the center leg portion of the U-tube towards the small openings, is promoted by liquid surface tension and the high velocity of the upwardly flowing vaporized refrigerant. Thus, in a preferred embodiment of the invention, an apron or strainer baffle is disposed directly below the plurality of small openings in the strainer plate. The apron baffle prevents droplets of liquid refrigerant which may collect on the bottom surface of the strainer plate, from moving into the area of the small openings, and into the stream of vaporized refrigerant. Also, in a preferred embodiment of the invention, a ring baffle is disposed about the center leg of the U-tube, spaced below the apron baffle, to prevent liquid refrigerate and compressor oil from moving up the center leg and into the plurality of small openings in the strainer plate.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
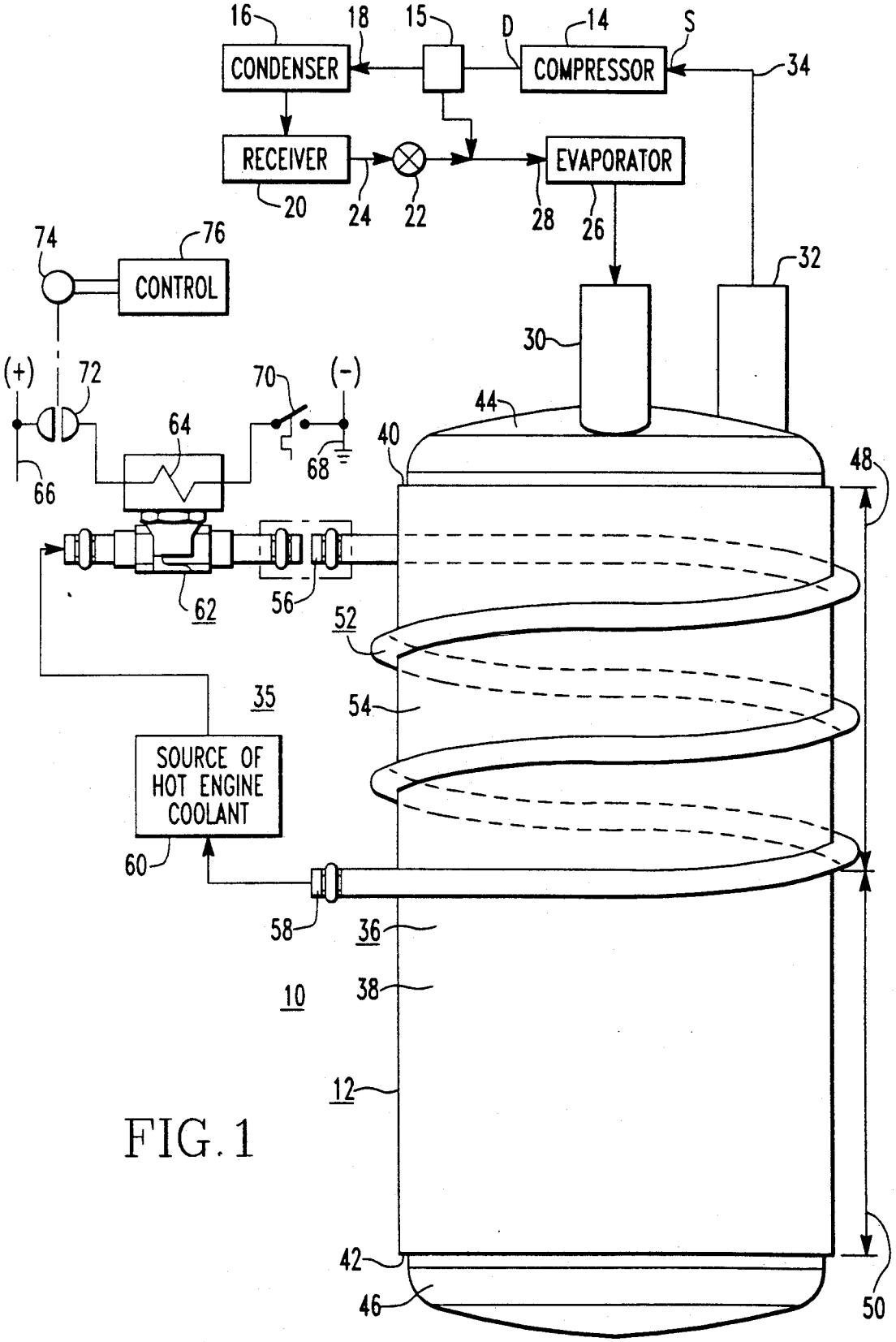
FIG. 1 is a partially block and partially schematic diagram of a refrigeration system, illustrating an elevational view of a heated accumulator constructed according to the teachings of the invention.

Referring now to the drawings, and to FIG. 1 in particular, there is shown a vapor compression refrigeration system 10 having a heated accumulator 12 which is constructed according to the teachings of the invention. Refrigeration system 10 includes a compressor 14 having a discharge port D connected to a three-way valve 15, or two separate valves, via a hot gas line 18. Valve 15 includes first and second selective configurations which initiate cooling and hot gas heating cycles, respectively. In the first or cooling configuration of valve 15 compressor 14 is connected to a condenser 16 via the hot gas line 18. Condenser 16 is connected to a refrigerant receiver 20, and receiver 20 is connected to a metering device 22, such as a thermostatic expansion valve, via a liquid line 24. Metering device 22 is connected to an evaporator 26 via a refrigerant distributor 28. The output of evaporator 26 is connected to an input tube 30 of accumulator 12, and an outlet U-tube 32 of accumulator 12 is connected to a suction port S of compressor 14 via a suction line 34. In the second or heating configuration of valve 15, compressor 14 and hot gas line 18 are connected to the input of evaporator 26.

Figure 2:
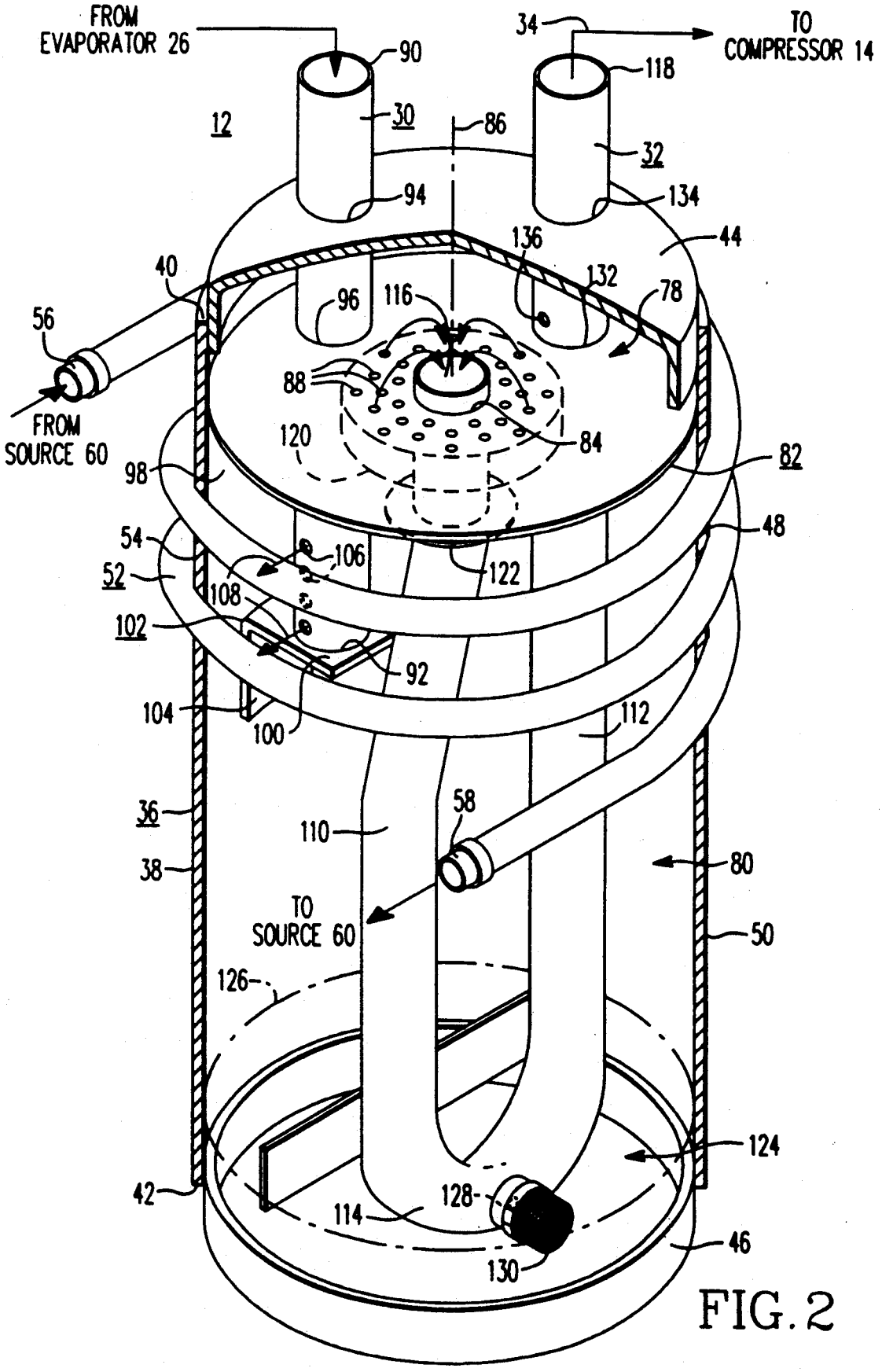
FIG. 2 is a perspective view of the accumulator shown in FIG. 1, shown partially cut-away, illustrating an internal construction of the accumulator which rapidly heats and vaporizes incoming liquid refrigerant, without significant boil-over, according to the teachings of the invention.

When the ambient temperature is below a predetermined value, heat is applied to accumulator 12 by heating means 35 during predetermined heat related operating cycles. For example, heat is applied by heating means 35 during a heating cycle required to hold a selected set point temperature in a cargo space which contains a conditioned load, and heat is also applied by heating means 35 during a defrosting cycle initiated to defrost evaporator coil 26. As illustrated in FIGS. 1 and 2, accumulator 12 includes an upright cylindrical metallic tank 36 formed of a suitable metal such as steel or aluminum. Tank 36 includes a side wall portion 38 having upper and lower ends 40 and 42, respectively, with the upper and lower ends 40 and 42 being closed by upper and lower end or tank caps 44 and 46, respectively.

Unlike prior art teachings, heat, when applied by heating means 35, is applied to an upper portion 48 of accumulator tank 12, eg., approximately the upper one-half of the height dimension between the upper and lower ends 40 and 42 of the cylindrical side wall portion 38. No heat is deliberately applied to the lower one-half 50 of the accumulator tank, and it is important that no heat be deliberately applied to area 50 of the accumulator 12.

Heat may be electrically generated and applied by heating means 35 to the upper portion 48 of accumulator tank 36, such as by wrapping an electrically heated pad about the upper tank portion 48 which is selectively connectable to a source of potential, such as to a generator or alternator associated with the refrigeration system 10; or, as illustrated in FIGS. 1 and 2, the upper portion 48 of tank 36 may be heated by heating means 35 which includes a heat transfer tube 52 and a hot liquid heat transfer liquid. The heat transfer tube 52, which is constructed of a suitable metal, is fixed in good heat transfer relation with the outer surface 54 of side wall portion 38, and the hot heat transfer liquid is selectively passed through the heat transfer tube 52 when heating of accumulator 12 is desired. Heat transfer tube 52 has first and second ends 56 and 58, respectively, and a length which permits it to be wrapped about the circumference of side wall portion 38 for a predetermined number of spaced turns. To insure a good heat transfer between heat transfer tube 52 and outer surface 54, tube 52 is preferably soldered or welded to outer surface 54.

A heated liquid for selective circulation through heat transfer tube 52 may be provided by a source 60 of hot engine coolant. For example, when compressor 14 is driven by a dedicated internal combustion engine, source 60 may be the dedicated engine which functions as the compressor prime mover. When refrigeration system 10 is a transport refrigeration system associated with a vehicle having a drive engine, such as a straight truck or tractor-trailer, source 60 may be the engine of the associated vehicle.

Hot coolant from the engine block of source 60 is connected to the first end 56 of heat transfer tube 52 via a solenoid valve 62 having an electrical coil 64 connected to be energized by an electrical circuit which includes first and second conductors 66 and 68, an ambient temperature sensing switch 70, and a normally open contact 72 from a heating cycle switch means or relay 74 associated with refrigeration control 76. Ambient temperature sensing switch 70 is open above a predetermined ambient temperature, and closed at and below the predetermined ambient temperature. Heat relay 74 is energized during heating and defrost cycles of refrigeration system 10. Heat relay 74, when energized, also initiates the switching of valve 15 to the second configuration, to start a hot gas heating cycle. The second end 58 of heat transfer tube 52 is connected to return the coolant to the water pump of source 60.

FIG. 2 is a perspective view of accumulator 12, with side wall portion 38 of tank 36, and with the upper tank cap 44, both being shown in section, in order to clearly illustrate a new and improved internal construction of accumulator 12 which accomplishes the objects of the invention. Cylindrical tank 36 is divided into upper and lower tank chambers 78 and 80, respectively, by a strainer plate member 82. Strainer plate member 82 is disposed close to the upper end 40 of tank side wall portion 38 such that the upper tank chamber 78 is much smaller in volume than the lower tank chamber 80. Strainer plate member 82 includes a plurality of openings. In a preferred embodiment of the invention strainer plate member 82 includes a relatively large first opening 84 which is concentric with a vertical centerline 86, and a plurality of smaller second openings 88 which are disposed to closely surround the first opening 84. An exemplary diameter for the first opening 84 is 1.0 inch (2.5 cm), while an exemplary diameter for each of the second openings 88 is 0.1875 inch (5 mm).

The inlet tube 30 includes first and second ends 90 and 92, with the first end 90, which is outside tank 36, being adapted for connection to receive refrigerant from evaporator 26. Inlet tube 30 extends in fluid sealed relation through an opening 94 the upper tank cap 44, and also through an opening 96 in the strainer plate 82, such that the second end 92 extends almost to the midpoint of the vertical height dimension of tank 36. Openings 94 and 96 are located such that inlet tube 30 is closely adjacent to the inner surface 98 of tank side wall 38. The second end 92 of inlet tube 30 is closed, such as by a first leg 100 of a right angle bracket member 102, which member also functions to stabilize the location of inlet tube 30 via a second leg 104 which is suitably fixed to inner surface 98 of side wall 38. The side wall of inlet tube 30 is provided with a plurality of refrigerant swirl ports 106 which are oriented such that refrigerant entering tank 36 will be directed into a vortex about the inner surface 98 of the upper portion 48 of tank side wall 38, directing any liquid refrigerant entering tank 36, indicated by arrows 108, into direct, intimate, sweeping contact with inner surface 98, directly opposite to the outer surface 54 to which heat is selectively applied during heating and defrost cycles.

The outlet U-tube 32 includes first and second upstanding leg members 110 and 112, respectively, integrally joined at their lower ends by a bight portion 114. The outlet U-tube 32 includes first and second ends 116 and 118 which are respectively disposed at the upper ends of the first and second leg members 110 and 112. The first leg member 110 is substantially aligned with vertical axis 86, extending upwardly through the lower tank chamber 80 such that the first end 116, which is open, extends into fluid flow communication with the upper tank chamber 78 via the centrally located first opening 84 in strainer plate member 82.

An apron or strainer baffle 120, which is preferably constructed of extruded metal, for example, is disposed about the first leg member 110, directly below the plurality of closely spaced second openings 88 in strainer plate member 82.

A U-tube ring baffle member 122 is disposed about the first leg member 110 at a location which is directly below, but spaced a predetermined short dimension from, the apron baffle 120. The spacing may be 1.0 inch (2.5 cm), for example, and baffle member 122 may have a diameter of 2.0 inches (2.5 cm), for example.

The bight portion 114 of outlet U-tube 32 is disposed at the lowest location in the lower tank chamber 80, with the lower portion of lower tank chamber 80 defining a sump 124 which contains a mixture of liquid refrigerant and compressor oil at a variable level indicated generally by broken line 126. An oil return metering orifice 128 is provided in bight portion 114, with orifice 128 being surrounded by a debris straining screen member 130.

The second leg member 112 of outlet U-tube 32 extends upwardly through an opening 132 in the strainer plate member 82, and through a fluid-tight opening in upper tank cap 44, such that the second end 118, which is adapted for connection to suction line 32, is outside accumulator tank 36. An anti-siphon port 136 is provided in the second leg member 112, such as in the upper tank chamber 78.

In the operation of accumulator 12, when the ambient temperature closes ambient temperature switch 70 and refrigeration control 76 energizes heat relay 74 to close contacts 72, coolant control valve 62 is opened to circulate hot engine coolant from coolant source 60 through the heat transfer tube 52 which encircles the upper portion 48 of tank side wall 38 in good heat transfer relation with the outer surface 54. Refrigerant 108 entering the heated accumulator 12 swirls around the upper portion 48 of tank side wall 38 in intimate, sweeping, flowing contact with the inner surface 98. Thus, heat is transferred quickly and efficiently into the swirling vortex of liquid refrigerant. Vaporized refrigerant escapes the vortex towards the center of the vortex, ie., towards the centerline 86 of tank 38, rising upwardly. The vaporized refrigerant is first forced to flow around the U-tube ring baffle 122, causing any large droplets of refrigerant in the vaporized flow stream to impinge upon, and collect upon, ring baffle 122, where they form a film which flows down the first leg member 110 to sump 124. Ring baffle 122 also prevents liquid refrigerant and compressor oil from climbing up center leg 110, past the location of ring baffle 122, under the influence of liquid surface tension and the high velocity of the refrigerant vapor flowing through the strainer openings 88.

The vaporized refrigerant, which is still substantially centered in tank 36 after passing baffle 122, continues to flow upwardly through the apron baffle 120, and then through the plurality of relatively small openings 88 in strainer plate member 82, into the upper tank chamber 78. The apron baffle 120 stops droplets of liquid refrigerant which collect on the lower surface of the strainer plate member 82 from moving into the location of openings 88, under the influence of liquid surface tension and the high velocity of the refrigerant vapor flowing through the strainer openings 88.

The upper tank chamber 78 is at the relatively low suction pressure of compressor 14, which draws the refrigerant vapor into the open first end 116 of the outlet U-tube 32. As the vaporized refrigerant flows through the bight portion 114, a small amount of compressor oil is drawn through the metering orifice 128 and into the flowing stream of refrigerant vapor.

The efficient heat transfer from the outer surface of the relatively thin tank side wall 38 directly into the swirling vortex of liquid refrigerant which is sweeping the immediately adjacent inner surface, satisfies a first object of the invention, as it rapidly increases the amount of refrigerant available in the active heating circuit of refrigeration system 10, insuring a relatively short defrost cycle, and a relatively short heating cycle to hold a set point temperature of a conditioned space.

Applying heat to the swirling vortex of liquid refrigerant, at a location which is well above the liquid refrigerant 126 in the sump 124, insures that liquid refrigerant 126 in the sump 124 will not boil over and flood compressor 14 with damaging liquid carry-over, satisfying a second object of the invention. In other words, the highly efficient removal of heat from the hot coolant in the upper tank chamber 78 via the swirling vortex of liquid refrigerant results in very little heat reaching sump 124 by conduction downwardly through the tank side wall 38.

In a preferred embodiment of the invention, an apron baffle and a U-tube baffle prevent liquid refrigerant and compressor oil from being drawn into the vaporized stream of refrigerant flowing upwardly through the relatively small openings 88 in the strainer plate member 82.

We claim:

1. A refrigerant accumulator for interconnecting a refrigerant evaporator with a suction port of a refrigerant compressor, comprising:

an upright, cylindrical metallic tank, said tank having a side wall which defines inner and outer surfaces, and upper and lower ends, means closing said upper and lower ends, a plate member disposed to divide said tank into a relatively small upper chamber located near said closed upper end, and a lower chamber which defines a sump, an outlet U-tube in the lower chamber having a first end disposed in vapor flow communication with said upper chamber via a first opening in the plate member, and a second end located outside said tank which is adapted for connection to a suction port of a refrigerant compressor, a refrigerant inlet tube having a first end outside the tank which is adapted for connection to a refrigerant evaporator, and a second end which extends into said tank, said refrigerant inlet tube defining at least one swirl port adjacent to said second end, with said at least one swirl port being located below and adjacent to the plate member, and oriented to direct liquid refrigerant which enters the inlet tube into a vortex against the inner surface of a predetermined upper portion of said tank side wall, and heating means for selectively heating said predetermined upper portion of the tank sidewall, whereby liquid refrigerant in the vortex is vaporized by the heating means in the upper portion of the tank, with vaporized refrigerant escaping the vortex and rising into the upper chamber via at least one second opening in the plate member, for removal via the outlet U-tube.

2. The refrigerant accumulator of claim 1 including an apron baffle disposed below the plate member, adjacent to the at least one second opening, directing vaporized refrigerant into the upper chamber via said apron baffle while preventing flow of liquid refrigerant which collects on the plate member from being drawn into vaporized refrigerant which rises into the upper chamber.

3. The refrigerant accumulator of claim 1 wherein the first opening in the plate member is centrally located, and including a plurality of additional openings in the plate member through which vaporized refrigerant may rise into the upper chamber, with said plurality of additional openings being closely spaced about said centrally located first opening.

4. The refrigerant accumulator of claim 3 including an apron baffle disposed below the plurality of openings in the plate member, to stop flow of liquid refrigerant which may collect on the plate member from moving into the area of the plurality of openings due to liquid surface tension and the velocity of the vaporized refrigerant flowing through the plurality of openings.

5. The refrigerant accumulator of claim 1 including a plurality of vertically spaced swirl ports in the refrigerant inlet tube in addition to the at least one swirl port, disposed adjacent to the second end of the refrigerant inlet tube.

6. The refrigerant accumulator of claim 1 wherein the heating means includes a metallic heat transfer tube fixed in heat transfer relation to the upper portion of the tank side wall to be selectively heated.

7. The refrigerant accumulator of claim 6 wherein said metallic heat transfer tube has first and second ends adapted for connection to a source of heated liquid.

8. The refrigerant accumulator of claim 7 including controllable valve means disposed to selectively allow heated liquid to flow through the heat transfer tube.

9. The refrigerant accumulator of claim 8 including control means for selectively energizing said controllable valve, with said control means including ambient temperature switch means which closes to enable energization of the controllable valve at and below a predetermined ambient temperature, and heating cycle switch means which is closed while an associated refrigeration system is in a hot gas heating cycle.

10. The refrigerant accumulator of claim 1 wherein the outlet U-tube includes an anti-siphon port disposed between the plate member and the means which closes the upper end of the tank.

11. The refrigerant accumulator of claim 1 wherein the outlet U-tube has first and second leg portions respectively connected to the first and second ends, and including ring baffle means disposed to surround the first leg portion of the outlet U-tube, at a predetermined location below the plate member, with said ring baffle means preventing liquid refrigerant from climbing the first leg portion past the location of the ring baffle means.

12. The refrigerant accumulator of claim 1 wherein the outlet U-tube and the refrigerant inlet tube both extend through the plate member and through the means which closes the first end of the tank.

* * * * *